United States Patent [19]

Yamashita et al.

[11] Patent Number: 5,043,545

[45] Date of Patent: Aug. 27, 1991

[54] MICROSWITCH

[75] Inventors: Masatsugu Yamashita, Osaka; Masayuki Maeda, Kyoto; Takahiro Sakakino, Aichi; Tsuyoshi Takata, Tohori, all of Japan

[73] Assignee: Omron Tateisi Electronics Co., Kyoto, Japan

[21] Appl. No.: 562,441

[22] Filed: Aug. 2, 1990

Related U.S. Application Data

[63] Continuation of Ser. No. 359,793, Jun. 1, 1989, abandoned.

[30] Foreign Application Priority Data

| | | | |
|---|---|---|---|
| Jun. 2, 1988 | [JP] | Japan | 63-73679[U] |
| Jun. 3, 1988 | [JP] | Japan | 63-73680[U] |
| Jun. 3, 1988 | [JP] | Japan | 63-74429[U] |
| Jun. 3, 1988 | [JP] | Japan | 63-74430[U] |
| Jun. 3, 1988 | [JP] | Japan | 63-74431[U] |
| Jun. 3, 1988 | [JP] | Japan | 63-74432[U] |
| Jun. 6, 1988 | [JP] | Japan | 63-74976[U] |
| Jun. 6, 1988 | [JP] | Japan | 63-74977[U] |

[51] Int. Cl.[5] ..... H01H 13/10

[52] U.S. Cl. ..... 200/293; 200/303; 200/284; 200/459

[58] Field of Search ..... 200/293, 303, 341, 453, 200/459, 461, 332, 335, 284, 345

[56] References Cited

U.S. PATENT DOCUMENTS

| | | | |
|---|---|---|---|
| 2,820,125 | 1/1958 | Huetten | 200/283 |
| 2,840,657 | 6/1958 | Roeser | 200/303 |
| 3,187,132 | 6/1965 | Dennison | 200/461 |
| 3,284,605 | 11/1966 | Anderson et al. | 200/284 |
| 3,614,364 | 10/1971 | Bedocs | 200/345 |
| 3,803,342 | 4/1974 | Stearley et al. | 200/284 |
| 4,013,856 | 3/1977 | Joss et al. | 200/345 |
| 4,031,341 | 6/1977 | Wuthrich et al. | 200/345 |
| 4,097,706 | 6/1978 | Roddy | 200/293 |
| 4,295,017 | 10/1981 | Kashima et al. | 200/335 |
| 4,394,553 | 7/1983 | Feil | 200/332 X |
| 4,495,391 | 1/1985 | Kitao et al. | 200/284 |
| 4,585,914 | 4/1986 | Ohashi et al. | 200/284 |
| 4,638,151 | 1/1987 | Suwa | 200/345 |
| 4,673,778 | 6/1987 | Lewandowski et al. | 200/332 |
| 4,734,548 | 3/1988 | Cole | 200/283 |

FOREIGN PATENT DOCUMENTS

| | | | |
|---|---|---|---|
| 1149612 | 4/1969 | United Kingdom | 200/332 |
| 1404310 | 8/1975 | United Kingdom . | |
| 1442332 | 7/1976 | United Kingdom . | |
| 2010584 | 6/1979 | United Kingdom | 200/345 |

OTHER PUBLICATIONS

Soviet Inventions Illustrated, Derwent Week D23, Abstract No. F2657, VO3.

*Primary Examiner*—Henry J. Recla
*Assistant Examiner*—Glenn T. Barrett
*Attorney, Agent, or Firm*—Fish & Richardson

[57] ABSTRACT

A microswitch, comprising: a casing consisting of a base casing half and a cover casing half; a plurality of terminal pieces received, at their intermediate parts, in slots provided in the base casing half and extending substantially perpendicularly from a surface opposing a corresponding surface of the cover casing half; a contact mechanism accommodated in a cavity in the casing and electrically connected to the terminal pieces; and a push-button member elastically supported by a spring member and projecting out of the casing for actuating the contact mechanism by movement of the push-button member; the terminal pieces being provided with projections extending from their leading edges, and the slot being provided with a recess for receiving the projection; wherein the slot comprises an external part and an internal part which is narrower than the external part, and a projecting length of the projection is larger than a depth of the internal part. Thereby, the projection may be easily fitted into the recess because the terminal piece is still in the broader part of the slot and can be easily shifted at this stage, but, once the projection is received in the recess, the terminal piece is securely held in position by the narrower part of the slot.

10 Claims, 14 Drawing Sheets

FIG. 10
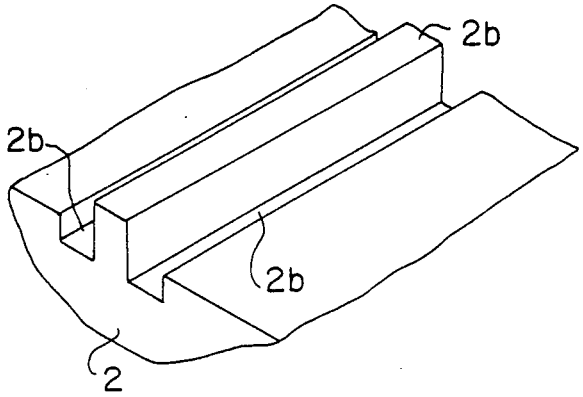
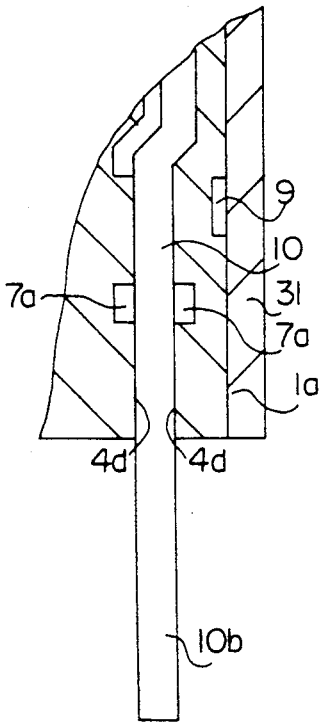
FIG. 9
FIG. 11
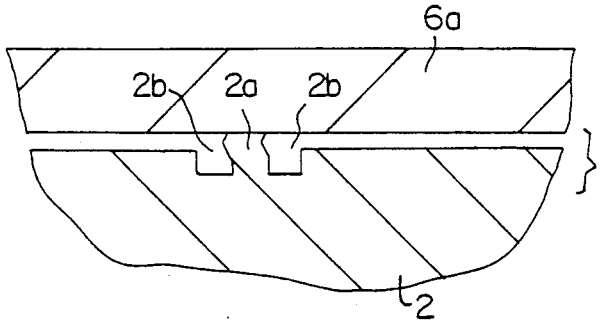
FIG. 12
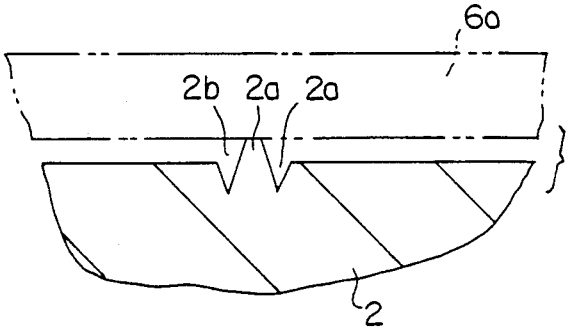

MICROSWITCH

This application is a continuation of U.S. application Ser. No. 07/359,793, filed June 1, 1989, now abandoned.

TECHNICAL FIELD

The present invention relates to a microswitch, more particularly, to a microswitch which can be actuated with a small actuating stroke and is suitable for use as limit switch.

BACKGROUND OF THE INVENTION

Microswitches are widely used as limit switches, and are desired to be reliable and compact. Further, they must be suitable for automated mass production in order to reduce the cost. In automated mass production, terminal pieces are mounted by automated assembly machines, and it is therefore important that terminal pieces may be mounted without requiring high positional precision, but the terminal pieces must be kept securely in position once they are mounted.

Also, since the terminal pieces are kept in position by the casing of the microswitch, a considerable dimensional accuracy is required to keep the terminal pieces securely in position without involving excessive play or deformation of the casing.

Further, the interior of the casing is so small and, hence, the distance between the outer ends of the terminal pieces and the contact mechanism formed at their inner ends is so small that a special care is required to prevent soldering flux from infiltrating into the casing interior or into the contact mechanism when soldering lead wires to the outer ends of the terminal pieces.

BRIEF SUMMARY OF THE INVENTION

In view of such problems of the prior art, and the aforementioned considerations, a primary object of the present invention is to provide a microswitch using a terminal piece mounting structure which permits smooth fitting of a terminal piece into a fitting slot provided in a casing.

A second object of the present invention is to provide a microswitch which is compact but protected from the infiltration of soldering flux into the contact mechanism at the time of soldering.

A third object of the present invention is to provide a microswitch which can be used in any orientation without impairing its reliability.

A fourth object of the present invention is to provide a microswitch which is compact and durable.

According to the present invention, these and other objects of the present invention can be accomplished by providing a microswitch, comprising: a casing consisting of a base casing half and a cover casing half; at least a pair of terminal pieces received, at their intermediate parts, in slots provided in the base casing half and extending substantially perpendicularly from a surface opposing a corresponding surface of the cover casing half, each of the terminal pieces being provided with a first end extending in a cavity defined in the casing and a second end extending out of the casing; a contact mechanism accommodated in the cavity and electrically connected to the terminal pieces; and a push-button member elastically supported by spring means and projecting out of the casing for actuating the contact mechanism by movement of the push-button member; at least one of the terminal pieces being provided with a projection extending from its leading edge which is adapted to be received in one of the slots, and the slot being provided with a recess for receiving the projection; wherein the slot comprises an external part adjoining the cover casing half and an internal part, adjoining the recess, the internal part being narrower than the external part, and a projecting length of the projection as measured from the leading edge of the terminal piece is larger than a depth of the internal part measured as a distance between a bottom surface of the internal part and a boundary between the external part and the internal part.

Thereby, the projection may be easily fitted into the recess because the terminal piece is still in the broader part of the slot and can be easily shifted at this stage, but, once the projection is received in the recess, the terminal piece is securely held in position by the narrower part of the slot.

According to a preferred embodiment of the present invention, the internal part and the external part are both defined by mutually parallel side walls of the slot, and the two parts are separated by stepped shoulder surfaces. Alternatively, the external part may be defined by a pair of converging wall surfaces of the slot, and the internal part is defined by a pair mutually parallel side wall surfaces of the slot, the two parts being separated from each other by continuous transition of the converging wall surfaces to the parallel wall surfaces of the slot.

According to another preferred embodiment of the present invention, the slot is provided with a groove extending substantially over its entire depth. This groove serves as a flux pocket for preventing the infiltration of flux into the casing at the time of soldering. Therefore, the reliability of the contact mechanism can be improved. Preferably, the cover casing half is provided with a pair of side walls which extend along external side surfaces of the base casing half in parallel with the slot, and another groove extending in parallel with the groove is defined between one of the side walls of the cover casing half and a corresponding one of the external side surfaces of the base casing half. This groove serves as an additional flux pocket which prevents infiltration of flux into the interior of the casing through the parting line between the two casing halves.

According to a certain aspect of the present invention, the first end of the terminal piece is supported by two points of the base casing half, one of the support points located in relatively less flexible part of the base casing half being made of a readily deformable projection. Since any dimensional or positional error is accommodated by the deformable projection, deformation of the casing or insufficient support for the terminal piece can be avoided even when the shape and dimensions of the terminal pieces are not very precise. Preferably, the deformable projection is provided with grooves on either side thereof to make it even more deformable. Additionally or alternatively, the projection may be provided with a tapered free end.

According to a preferred embodiment of the present invention, the first end carries a contact point and is provided with a lateral projection adjacent to the contact point to the end of dissipating the heat generated at the contact point.

To achieve a stable movement of the push-button member, it is desired that the push-button member is provided with a pair of lateral projections which are engaged by a fringe of an opening of the casing through which a free end of the push-button member projects out of the casing, and a pair of sliding surfaces extending from the free end of the push-button member to an internal end of the push-button member, through the engagement portions. The effective length of the sliding surfaces can be increased even further if the casing is provided with a pair of projections which extends inwardly from the internal fringe of the opening so as to define sliding surfaces for sliding contact with the sliding surfaces of the push-button member. To prevent mutual striking between the external side surfaces of the push-button member and the mounting opening receiving the push-button member as a result of a rocking movement of the push-button member as it moves into and out of the casing, it is preferred that the opening be provided with a pair of shoulder portions defining a broader part of the opening at its outermost part thereof.

To achieve a uniform property of the microswitch irrespective of its orientation, it is preferred that the microswitch further comprises a lever member having an arm portion and a pair of lateral flanges extending from a base end thereof and each provided with an opening which is fitted upon a projection provided in the casing, an intermediate point of the arm portion abutting the free end of the push-button member, and each of the flanges being provided with an engagement portion which is engaged by a part of the casing so as to define an angular position of the arm portion most remote from the push-button member.

BRIEF DESCRIPTION OF THE DRAWINGS

Now the present invention is described in the following with reference to the appended drawings, in which:

FIG. 9 is a fragmentary sectional view of the microswitch showing the flux pockets for preventing the infiltration of soldering flux into the contact mechanism and other internal parts of the casing;

FIG. 10 is a fragmentary perspective view of a part of the base casing half;

FIG. 11 is a sectional view showing the deformable projection deforming under pressure from the terminal piece;

FIG. 12 is a view similar to FIG. 11 showing an alternate embodiment of the deformable projection;

DESCRIPTION OF THE PREFERRED EMBODIMENTS

Figure 1:
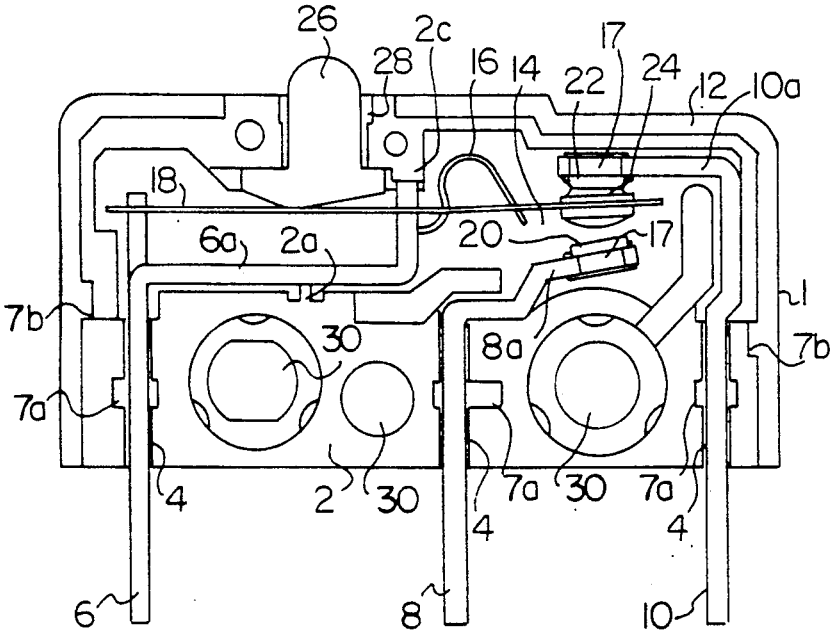
FIG. 1 is a front view showing the internal structure of a preferred embodiment of the microswitch according to the present invention.

In the drawing, numeral 1 denotes a main body casing made of resin material, and a block portion 2 projects from a lower half thereof. A moveable contact terminal piece 6 and two fixed contact terminal pieces 8 and 10 are mounted on this block portion 2 by being fitted into three slots 4 provided in a surface of the block portion 2. A switch movement space 14 is defined by the block portion 2 and a upright wall portion 12 in a part of the resin casing 1 located above the block portion 2, and upper parts **6*a*, 8*a* and 10*a* of the terminal pieces 6, 8 and 10 and a moveable piece 18 mounted on the upper part 6*a* of the terminal piece 6 via a spring plate 16 are arranged in this switch movement space 14 in such a manner that fixed contact pieces 20 and 22 attached to end portions of the upper parts 8*a* and 10*a* of the terminal pieces 8 and 10 oppose an end portion of the moveable piece 18 by way of a moveable contact point 24**.

Numeral 26 denotes a push-button which is mounted in an opening 28 provided in the upright wall 12, and its upper portion projects upwardly from the opening 28 while its lower portion is located above the moveable contact piece 18. As described above, when all the components are installed into the resin casing 1, a microswitch is completed by fitting a cover casing made of resin material not shown in the drawing to the casing 1 from its front part. Numeral 30 in the block portion 2 denotes the fitting holes into which bosses of the cover casing made of resin material are integrally fitted when the cover casing is mounted on the resin casing 1.

In the above described structure, when the push-button 26 is not depressed, the moveable piece 18 is urged upwardly by the spring force of a returning spring 16 consisting of a return spring, thereby bringing the moveable contact point 24 into contact with the fixed contact point 22. When the push-button 26 is depressed, the moveable piece 18 is pushed downward by the push-button 26 against the spring force of the return spring 16, thereby bringing the moveable contact point 24 in contact with the fixed contact point 20.

Figure 3:
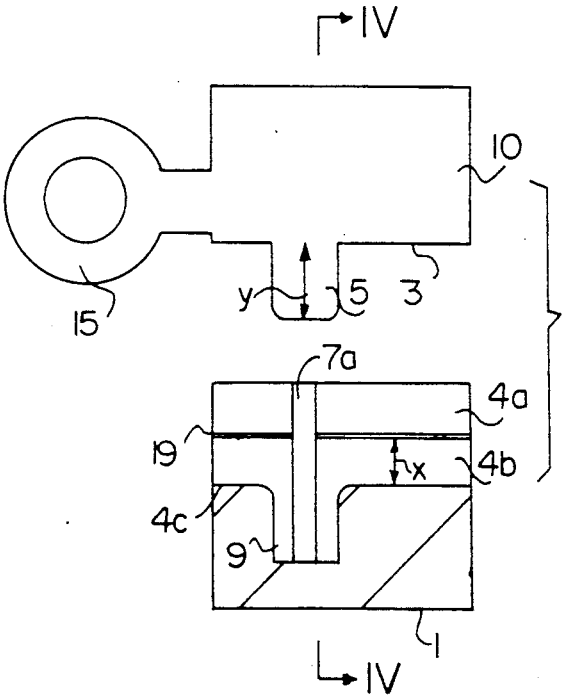
FIG. 3 is an enlarged sectional side view of the terminal piece and the fitting slot.
Figure 4:
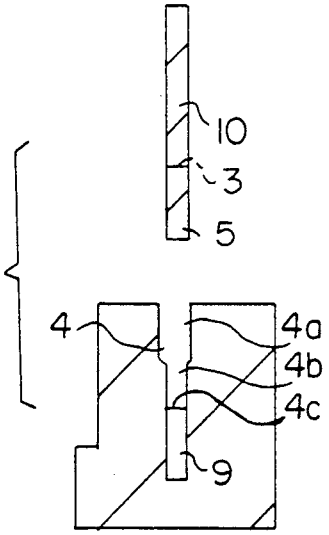
FIG. 4 is a sectional front view taken along line IV-IV of FIG. 3.

In such a microswitch, the terminal pieces 6, 8 and 10 are mounted by fitting them into the fitting slots 4 as mentioned previously, and the mounting structure for them is now described in the following by taking the example of the terminal piece 10 with reference to FIGS. 3 and 4.

A fitting end side edge 3 of the terminal piece 10 is provided with a positioning projection 5, and a corresponding positioning recess 9 is provided at the bottom of the fitting slot 4. The two ends of the leading edge of the positioning projection 5 and the two ends of the opening of the positioning recess 9 are provided with fitting guide portions 11 and 13. When the terminal piece 10 is fitted into the fitting slot 4, the positioning projection 5 is fitted into the positioning recess 9, and the positioning of the terminal piece 10 with respect to the fitting slot 4 along the direction indicated by the arrow A is thereby accomplished. The upper portion 10*a* of the terminal piece 10 is provided with the aforementioned fixed contact point, and the positioning in the direction indicated by the arrow is required to be accurately performed in order to place the fixed contact 22 in aligned relationship with the moveable contact point 24 as prescribed.

However, in such a structure for mounting a terminal piece 10 on a resin casing 1, there has been a problem that the fitting of the terminal piece 10 into the fitting slot 4 may not be performed in a smooth fashion.

Fitting of the terminal piece 10 into the fitting slot 4 is typically performed by an automated assembling machine, and this machine performs the positioning of the terminal piece 10 in the slot 4 along the widthwise direction and, additionally, the positioning of the positioning projection 5 of the terminal piece 10 in the positioning recess 9 in the fitting slot 4 along the direction indicated by the arrow, but there have been the cases of positioning errors.

When there is a widthwise error in the position of the terminal piece 10 in the fitting slot 4, since the width of the fitting slot 4 and the width of the terminal piece 10 are substantially identical, the resin casing 1 of the terminal piece 10 may be damaged.

When there is an error in the positioning of the positioning projection 5 in relation with the positioning recess 9, it is designed that a complete fitting may be accomplished by relative shifting of the positions of the positioning projection 5 and the positioning recess 9 produced by virtue of the fitting guide portions 11, 13. However, in reality, such a complete fitting may not be achieved because of the frictional resistance which the two sides of the terminal piece 10 receive from the side walls of the fitting slot 4.

Figure 2:
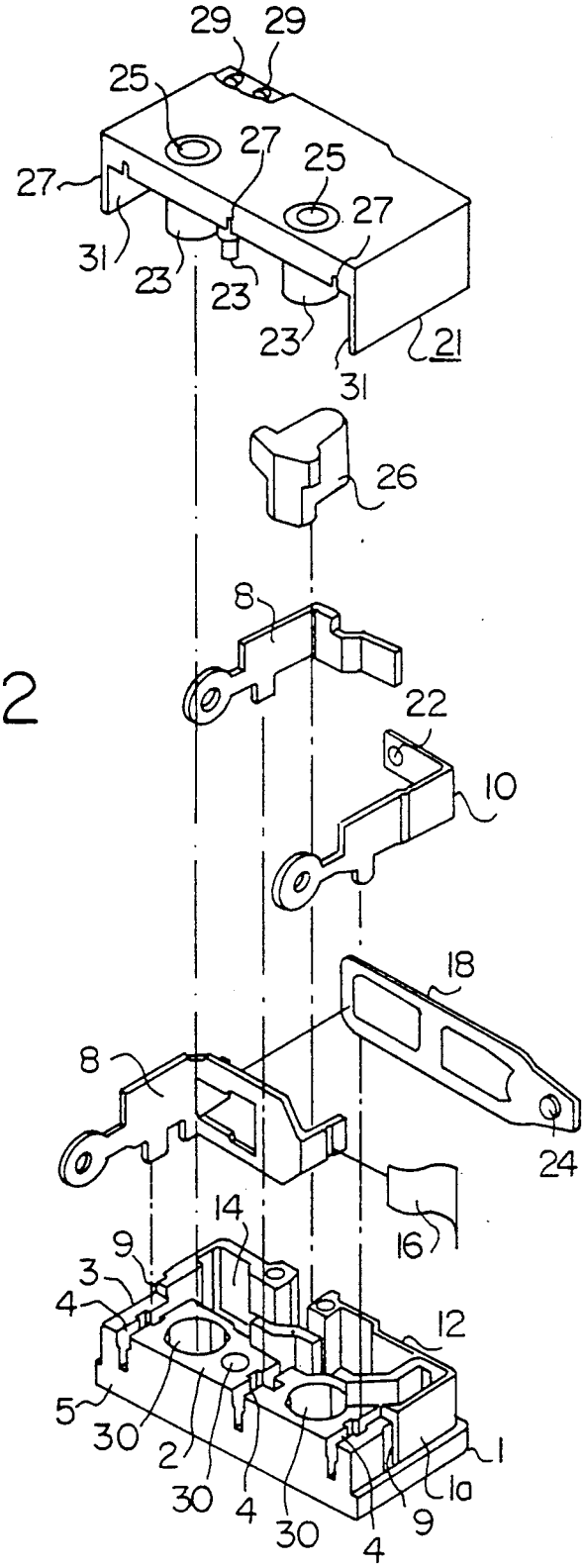
FIG. 2 is an exploded perspective view of the same.

In FIG. 2, numeral 21 denotes a cover casing made of resin material, and its internal surface is provided with three bosses 23 of various sizes which are adapted to be fitted into corresponding holes 30 provided in the resin casing 1 of the main body when the cover casing 21 is mounted on the resin casing 1. Thus, the overall casing consists of a base casing half or the resin casing 1 and a cover casing half or the resin casing 21. The two larger bosses 23 on either side are cylindrical in shape, and their through holes 25 are used as mounting holes for the microswitch. The cover casing 21 is provided with fitting slots 27 for terminal pieces 6, 8 and 10 at those parts corresponding to fitting slots 4 of the resin casing 1. A corner portion of the external surface of the resin casing 21 is provided with a pivot portion 29 projecting therefrom for pivotally mounting an actuator 26 for selectively applying pressure to the push-button 26. A similar pivot portion is provided also in the resin casing 1 at its part corresponding to the pivot portion 29 of the resin casing 21.

Now, in the following is described the structure for fitting the terminal pieces 6, 8 and 10 into the fitting slots 4 of the resin casing 1, which constitutes a primary feature of the present invention, by taking the example of the terminal piece 10 and with reference to FIGS. 3 and 4.

The terminal piece 10 is provided with a positioning projection 5 at its fitting edge 5, and the fitting slot 4 is provided with a positioning recess 9. The fitting slot 4 is broader at its upper portion 4*a* than at its lower portion 4*b*, the boundary therebetween being defined by sloping steps 19. The depth x of the lower portion 4*b* is slightly smaller than the length y of the positioning projection 5. Numeral 7*a* denotes a flux pocket for preventing the infiltration of flux into the casing interior when performing soldering on the terminal portion 15.

Figure 5:
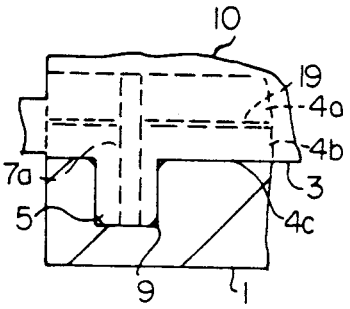
FIGS. 5 through 7 are sectional views similar to FIG. 3 showing how the terminal piece is fitted into the fitting slot in time sequence.

Now the process of fitting the terminal piece 10 into the fitting slot 4 is described in the following with reference to FIGS. 5 through 7.

Figure 7:
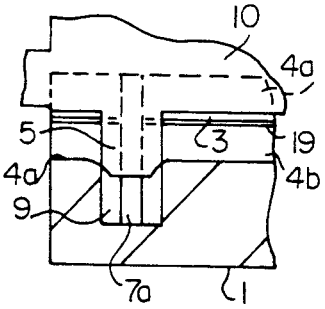

Since the upper portion 4*a* of the fitting slot 4 is relatively broad, the terminal piece 10 may be fitted into the fitting slot 4 easily even when the accuracy of the widthwise positioning is not very high, and the state shown in FIG. 7 can be reached without encountering any substantial friction. When the positioning projection 5 and the positioning recess 9 are in mutual alignment as shown in FIG. 7, by pushing the terminal piece 10, the positioning projection 5 fits into the positioning recess 9 while the lower part of the terminal piece 10 is fitted into the lower portion 4*b* of the fitting slot 4 as shown in FIG. 5. Since the boundary between the upper portion 4*a* and the lower portion 4*b* is defined by the sloping step 19, the fitting edge 3 of the terminal piece 10 would not be caught by the sloping step 19 as it is fitted fully into the lower portion 4*b*.

Figure 6:
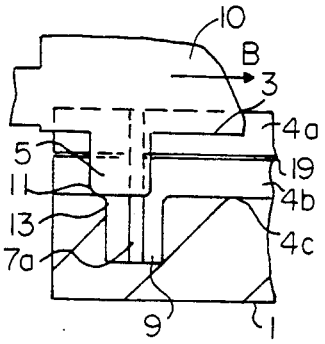

When there is a positioning error and the positioning projection and the positioning recess are not in mutual alignment as shown in FIG. 6, as the terminal piece 10 is further pressed downwardly, the positioning projection 5 fits into the positioning recess 9 before the lower portion of the terminal piece 10 is fitted into the lower portion 4*b* of the fitting slot 4 while the positioning projection 5 shifts relative to the positioning recess 9 by sliding over the bottom surface 4*c* of the fitting slot 4 in the direction indicated by the arrow B.

This shifting is smoothly accomplished because the fitting edge 3 of the terminal piece 10 is situated above the sloping steps 19 and the lower portion of the terminal piece 10 is located in the upper portion 4*a* of the fitting slot 4, substantially free from friction. Since this shifting takes place smoothly, the positioning projection 5 can fit into the positioning recess 9 in mutual alignment.

Figure 8:
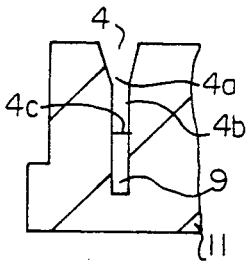
FIG. 8 is a view similar to FIG. 4 showing an alternate embodiment of the fitting slot.
Figure 13:
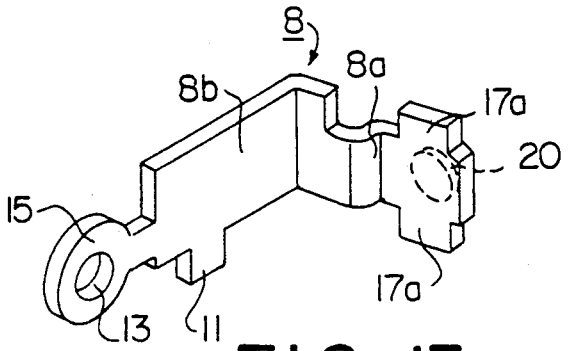
FIG. 13 is a overall perspective view showing one of the terminal pieces.
Figure 14:
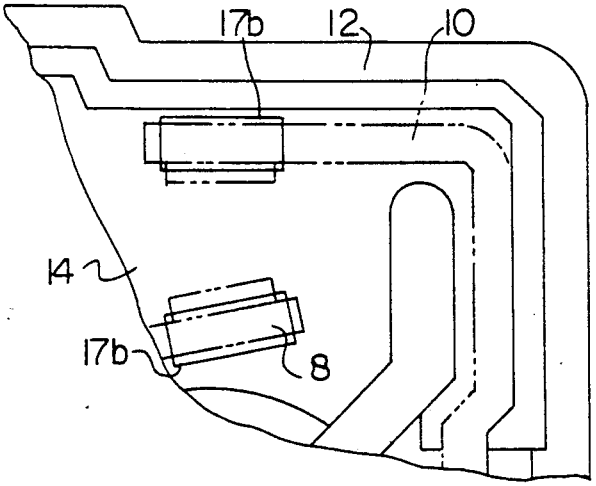
FIG. 14 is an enlarged fragmentary view showing a part of FIG. 1 in greater detail.
Figure 15:
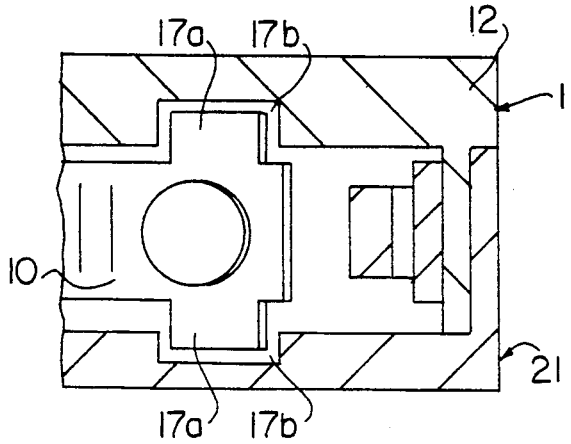
FIG. 15 is a sectional view showing the contact point mounted on a free end of one of the terminal pieces.

FIG. 8 shows an alternate embodiment of the fitting slot 4 according to which the upper portion 4*a* of the fitting slot 4 is progressively narrower towards its lower part so that the terminal piece 10 fitted into the upper portion 4*a* may be easily guided into the lower portion 4*b*.

According to the above described structures, since the terminal piece is fitted into the fitting slot from a wider upper part thereof, this fitting can be readily accomplished even when the positional accuracy in the widthwise direction is poor.

Further, since the fitting of the positioning projection into the positioning recess, involving some positional shifting, is made while the terminal piece is still in the wider upper part of the fitting slot and such positioning shifting can be easily accomplished without involving any substantial frictional force, the fitting process can be performed in a smooth fashion.

Therefore, according to the present embodiment, since the fitting of the terminal piece into the fitting slot involving some widthwise positioning and the fitting of the positioning projection into the positioning recess can be both accomplished in a smooth fashion, mounting of the terminal piece on the casing can be thereby accomplished smoothly and without damaging the casing.

Now the structure of the soldering flux pockets and the way in which these soldering flux pockets prevent infiltration of flux when soldering is described in the following particularly with reference to FIG. 9.

Cavities 7*a* or grooves provided in intermediate parts of the fitting slots 4 are flux pockets for stopping the infiltration of flux along the gap between the terminal pieces and the wall surfaces of the fitting slots 4 at the time of soldering. Grooves 7*a* are provided in the outer side surface 1*a* of each side end of the resin casing 1 which contacts the inner surface of the upright wall portion 31, over its entire width, in parallel with the bottom surface 5 of the resin casing 1 from which the terminal portions 6*b*, 8*b* and 10*b* of the terminal pieces 6, 8 and 10 project.

When flux is applied to the terminal portion 10*b* of the terminal piece 10 as a step preceding the soldering of a lead wire to the terminal portion 10 and some of it has clung to the bottom surface 5, the flux may enter the gap 4*d* defined between the terminal piece 10 and the wall surface of the fitting slot 4, but, since the cavity 7*a* is formed in an intermediate part of the gap 4*d*, the flux is intercepted by this cavity 7*a* without reaching the switch movement space 14. The flux also infiltrates through the gap between the side surface 1*a* of the resin casing 1 and the opposing surface of the resin casing 21, but, since the groove 7*b* is provided in an intermediate part of the side surface 1*a*, the flux cannot advance any further whereby the possibility of the flux reaching the switch movement space 14 along the outer side surface 1*a* of the resin casing 1 can be positively prevented.

According to this structure, the flux which is used in soldering lead wires to the terminal portions of the terminal pieces is intercepted by the flux pocket provided in the fitting gap of the casing halves even when the flux has entered this fitting gap.

Therefore, according to the present invention, flux for the soldering of lead wires to the terminal pieces is prevented from entering the interior of the casing through the fitting gap between the casing halves, whereby there is provided small electric apparatus which can prevent operation failure of the contact mechanism due to the infiltration of flux.

Now, in the following is described the positioning support structure for the upper portion 6*a* of the terminal piece 6 which constitutes another main feature of the present invention particularly with reference to FIGS. 10 and 11.

The support projection 2*c* (FIG. 1) of the upright wall 12 for supporting the bent portion of the upper portion 6*a* of the terminal piece 6 is shaped as an ordinary base having a relatively large width in the same way as in conventional arrangements, but the support projection 2*a* of the block portion 2 corresponding to the deformable projection for supporting the lower surface of the upper portion 6*a* consists of a relatively narrow ridge having a pair of grooves 2*b* on either side thereof. In other words, the support projection 2*a* is made weaker than the support portion 2*c* by constructing the support projection 2*a* as a narrow ridge, and, by taking into account the fact that the ridge is even more reduced in rigidity by providing grooves on either side thereof to make the support projection even more elongated in shape.

According to this structure, when the terminal piece 6 is mounted on the resin casing 1 of the main body or when the resin casing 1 is softened by the heat generated during use, the large force applied by the terminal piece 6 to the support projections 2*c* and 2*a* is prevented from causing deformation to the upright wall 12 as the relatively compliant support projection 2*a* is first deformed by collapsing, thereby reducing the force applied to the support projection 2*c*.

FIG. 12 shows an alternate embodiment of the present invention, in which the free end of the support projection 2*a* is tapered in such a manner as to cause collapsing deformation to occur more easily. Those parts of FIG. 12 corresponding to those of FIG. 11 are denoted with like numerals.

According to this structure, when pressure from the metallic member is applied to a plurality of points of the resin casing in positioning the metallic member in the casing, the deformable projection provided in the vicinity of the relatively rigid part of the casing is deformed, and the pressure is accommodated by this deformation in such a manner that the pressure to the support points of the casing of relatively compliant parts is reduced and the deformation of the compliant parts of the casing is prevented.

Therefore, according to the present embodiment, since, even when a large pressure is applied from the metallic member to the resin casing, the pressure is not transmitted to the compliant parts of the resin casing by deformation of the deformable projection, the deformation of the casing is positively prevented and the accurate positioning of the metallic member in a prescribed position of the resin casing is made possible.

In such a microswitch, the contact points 20, 22 and 24 generates heat due to the electric arc produced as a result of the switching operation, and their durability tends to be adversely affected by this heat. To overcome this problem, heat resistant contact material may be used for these contact points, but it causes an increase in the cost. Therefore, according to the present embodiment, each of the terminal pieces 6, 8 and 10 is provided with a pair of lateral extensions 17*a* on either side of its free end or adjacent to its contact point 20, 22 or 24. These extensions 17*a* serve as fins for dissipating heat therefrom. This effect is improved when the terminal pieces are plated with silver and other heat conductive material.

It is conceivable to use wider terminal pieces to produce the same effect, but in order to do so the size of the casing is required to be increased. However, according to this embodiment, the casing halves 1 and 21 are provided with local recesses 17*b* to accommodate the extensions 17*a* therein. Therefore, the thickness of the casing halves 1 and 21 is reduced only at these local recesses 17*b*, and the dimensions of the casing are thus not increased without in any diminishing the mechanical strengths of the casing halves 1 and 21.

To improve the heat dissipating capability, it is also possible to provide a third extension at the free end of each of the terminal pieces 6, 8 and 10.

Figure 16:
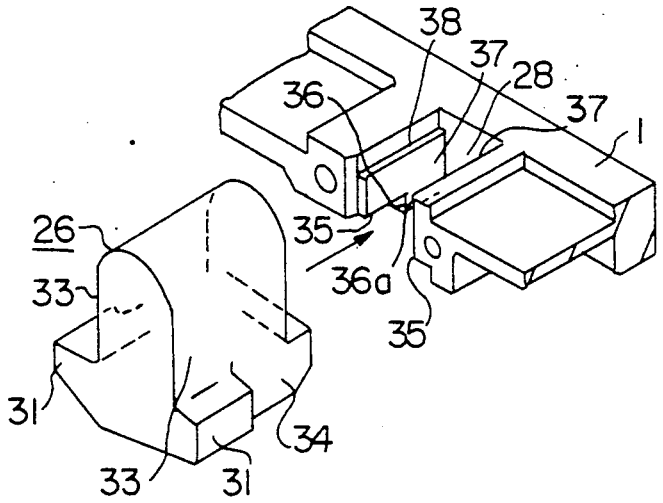
FIG. 16 is a fragmentary, exploded perspective view of the push-button member and the mounting opening provided in the casing.
Figure 17:
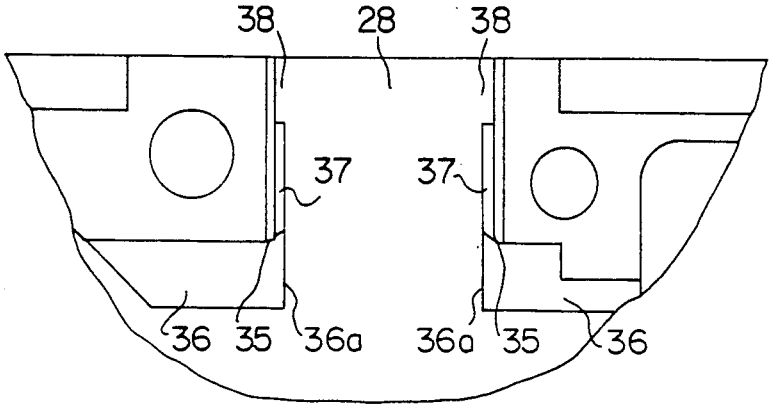
FIG. 17 is an enlarged fragmentary view showing a part of FIG. 1 in greater detail.

Now, the structure for supporting the push-button 26 is described in the following with reference to FIGS. 16 and 17.

According to this push-button 26, numeral 31 denotes engagement portions which are partly removed, as opposed to the engagement portions of a comparable conventional push-button, in such a manner that a vertical continuous surface is defined on a part of each of its side surfaces. By using such engagement portions 31, cut-off surfaces 34 corresponding the said removal of parts of the engagement portions on either side surface of the push-button are provided with larger vertical dimensions than the corresponding parts which are provided with the engagement portions 31.

Meanwhile, the parts of the lower fringe 35 of the mounting opening 28 cooperating with the engagement portions 31 of the push-button 26 which oppose the cut-off surfaces 34 when the push-button 26 is fitted into the mounting opening 28 are provided with extensions 36 defining sliding surfaces 35*a* for the push-button 26. By providing these sliding surfaces 36*a*, the inner side surfaces 37 of the mounting opening 28 corresponding to the outer side surfaces 33 of the push-button 26 are given with larger vertical dimensions than the other parts. Further, the upper fringe of the mounting opening 28 corresponding to the lower fringe 35 is provided with shoulder portions 38 in a depressed relationship.

Figure 18:
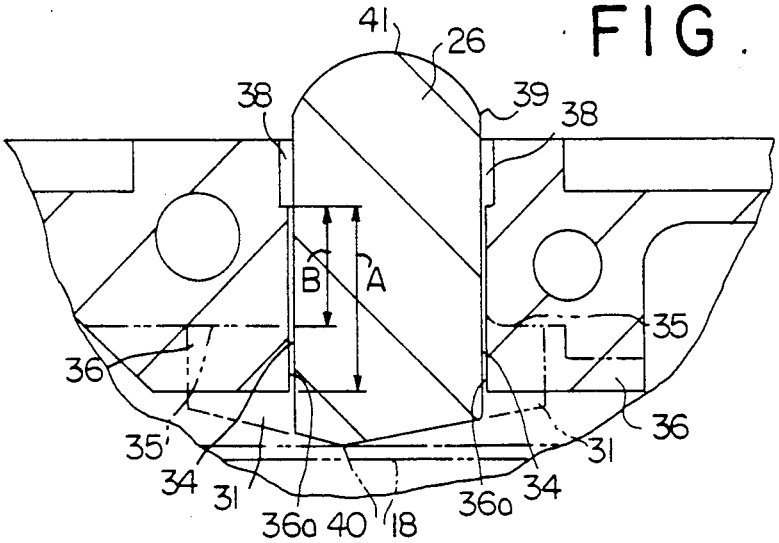
FIG. 18 is an enlarged sectional view of the push-button member and the mounting opening provided in the casing.

FIG. 18 is a sectional view showing the way the push-button 26 is fitted into the mounting opening 28; the push-button 26 is urged upwardly from below by the moveable piece 18, and is engaged by the lower fringe 35 of the mounting opening 28 at its engagement portions 28. In this mounted state, since the cut-off surfaces 34 are provided in the push-button 26 and the sliding surfaces 36*a* are provided in the mounting opening 28, the outer side surfaces 33 of the push-button 26 and the inner side surfaces 37 of the mounting opening 28 oppose each other over the long distance A defined by the sliding surfaces 34*a* and 36*a*. In other words, the sliding distance is increased from B to A.

When the push-button 26 is moved vertically as a result of its operation, a favorable sliding relationship is obtained by mutual sliding of the outer side surfaces 33 and the inner side surfaces 37 over the long distance A, and the push-button 26 is guided in a stable fashion without involving sticking.

Now the structure of the shoulder portions 38 provided in the upper end of the mounting opening 28 is described in the following.

The push-button 26 can move without rocking and, hence, without sticking by virtue of the long sliding distance achieved as described above, but, in reality, a slight rocking of the push-button 26 is inevitable. As result of such a rocking movement of the push-button 26, the upper parts 39 of the side surfaces collide with the upper end of the mounting opening 28, and these surfaces tend to wear off in time as a result of numerous occurrences of collision, ultimately, until the satisfactory operation of the push-button 26 becomes impossible. The shoulder portions 38 are provided for avoiding such wears resulting from repeated collisions by removing and the part of the upper end of the mounting opening with which the side portions 39 would collide as the push-button 26 is moved.

Figure 19:
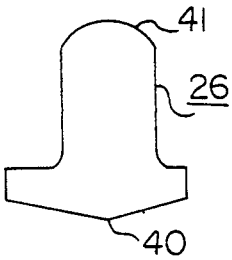
FIG. 19 is a front view of the push-button member.

In using a microswitch, a certain margin of displacement or MD (the difference between the stroke of the push-button required for closure of the contact points and the return stroke of the push-button required for opening the contact points from their closed state), and such an MD varies depending on the point of pressure application on the moveable piece 18 by the push-button 26. In other words, the MD is not the same for a push-button 26 in which the contact point 40 of the moveable piece 18 is substantially displaced from the pressure application point 41 as was the case in the above described embodiment and for a push-button in which the contact point 40 is situated right under the pressure application point 41 as shown in FIG. 19. The push-button 26 shown in FIG. 19, in which the contact point 40 is located right under the pressure application point 41, is preferred as it can move without rocking. On the other hand, a push-button 26, in which the contact point 40 is remote from the pressure application point 41 as was the case in the above described embodiment, is more prone to rocking movement.

Therefore, by providing the shoulder portions 38, even the push-button 26 which has a tendency to rock can be used without any substantial problem, and it becomes possible to select from a plurality of push-buttons 26 involving different relationships between the pressure application point 40 and the contact point 41. As a result, it has become possible to obtain a desired MD by selecting a suitable push-button 26.

According to this structure, since the sliding structure for guiding the movement of the push-button provides sliding surfaces which are longer than was possible heretofore, the push-button can be moved without involving the rocking movement of the same.

Furthermore, since the sliding surfaces are provided in the parts from which the engagement portions are removed, the overall length of the push-button is not required to be increased, and the vertical dimension of the mounting opening is also not required to be increased, so that the dimensions of the microswitch are in no way increased.

Therefore, according to the present embodiment, there is provided a microswitch which is compact and permits its push-button to be operated in a stable fashion without sticking.

Figure 20:
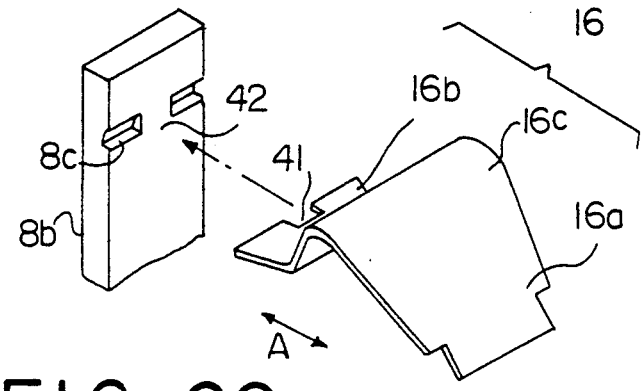
FIG. 20 is a fragmentary, exploded perspective view of the return spring and a support structure therefor.
Figure 21:
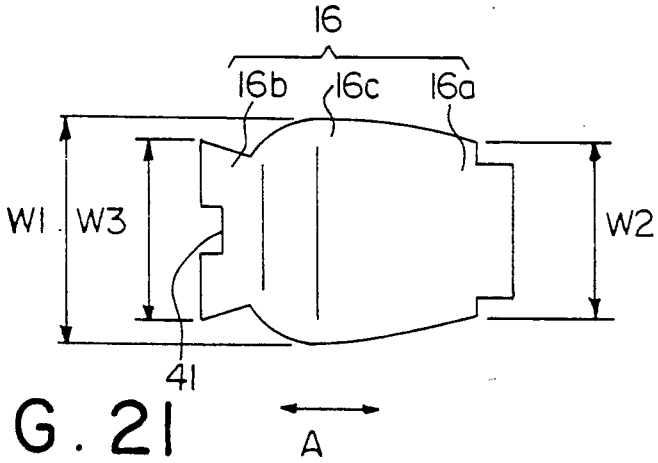
FIG. 21 is a plan view of the return spring.

FIGS. 20 and 21 show the return spring 16 consisting of a sheet spring and its mounting structure in greater detail. The base end 16*b* of the return spring 16 is bifurcated by being provided with a central notch 41 which is received by a pair of recesses 8*c* provided in the internal end 8*b* of the terminal piece 8 which are separated by a central portion 42. Thus, the bifurcated base end 16*b* of the return spring 16 is received by the recesses 8*c*, and the central portion 42 is received by the central notch 41 at the base end 16*b* of the return spring 16. This structure virtually eliminates the possibility of inadvertent disengagement between the return spring 16 and the terminal piece 8. The free end 16*a* of the return spring 16 is engaged to the moveable piece 18.

As best shown in FIG. 21, the widths W1, W2 and W3 of the middle part, the free end and the base end of the return spring 16 are determined so that the relationship $W1>W2$ and $W1>W3$ holds. This is advantageous because the middle part is subjected to the largest stress during its operation.

Figure 22:
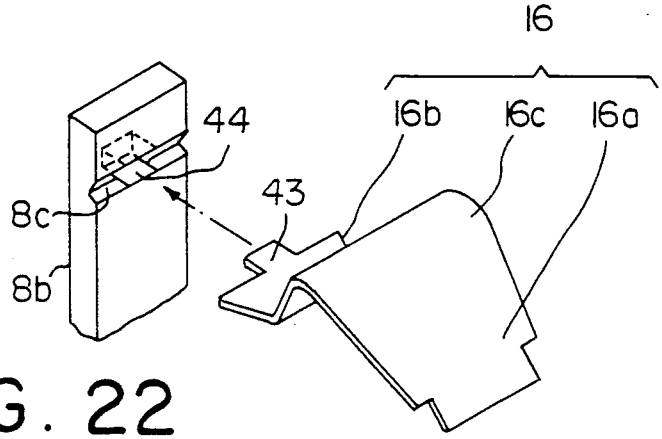
FIG. 22 is a view similar to FIG. 20 showing alternate embodiment of the return spring and its support structure.

FIG. 22 shows an alternate embodiment of the structure for supporting the base end 16*b* of the return spring 16. According to this embodiment, the base end 16*b* of the return spring 16 is provided with a central projection 43 instead of the notch 41 shown in FIGS. 20 and 21, and the internal end of the terminal piece 8 is provided with a pair of recesses 8*c* which are separated by an even deeper recess 44 instead of the planar central portion 42 shown in FIG. 20. This embodiment can produce substantially the same effect as the embodiment shown in FIG. 20 in ensuring the engagement between the return spring 16 and the internal end 8*b* of the terminal piece 8.

Now the structure for supporting the base end of the moveable piece 18 with a tab 8*a* provided in an intermediate part of the internal end of the terminal piece 8 is described in the following.

The base end of the moveable piece 18 consists of a lateral plate 51 extending laterally across the entire width of the moveable piece 18 defining a central opening 51*a*. The free end of the tab 8*a* which is bent from a central part of the terminal piece 8 is made narrower by a pair of shoulder surfaces 53 defined on either side of the tab 8*a*. The rear surface of this narrower free end of the tab 8*a* is provided with a lateral groove 52 extending over its entire width.

Therefore, according to this support structure, the free end of the tab 8*a* is passed through the central opening 51*a* of the moveable piece 18 and the lateral plate 51*a* is engaged by the lateral groove 52. Since the moveable piece 18 is urged toward its free end by the return spring 16, the moveable piece 18 is securely engaged by the tab 8*a*. Further, since the moveable piece 18 is supported by the base end of the push-button 26 and the shoulder surfaces 53, the moveable piece 18 is positively prevented from inadvertently coming off from the tab 8*a* of the terminal piece 8.

Figure 23:
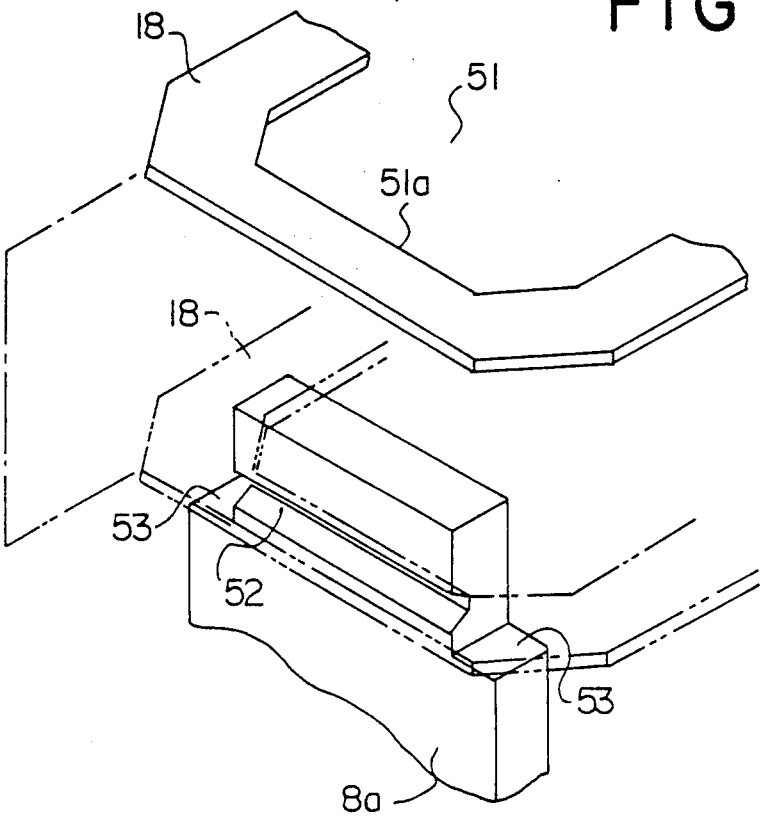
FIG. 23 is a fragmentary, exploded perspective view of the base end of the moveable piece and its support structure.
Figure 24:
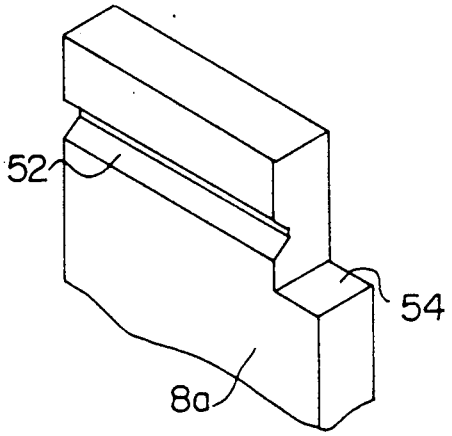
FIGS. 24 through 26 are fragmentary perspective views showing different embodiments of the support structure for the moveable piece.

FIG. 24 shows a modified embodiment of the support structure for the moveable piece 18. According to this embodiment, only one shoulder surface 54 is provided but this embodiment can offer substantially the same effect as the embodiment shown in FIG. 23.

Figure 25:
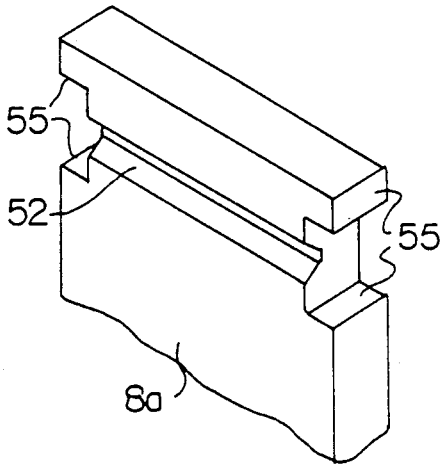

According to the embodiment illustrated in FIG. 25, the lateral sides of the moveable piece 18 are each retained by a pair of mutually opposing shoulder surfaces 55. According to this embodiment, even more secure retention of the base end of the moveable piece 18 is possible.

Figure 26:
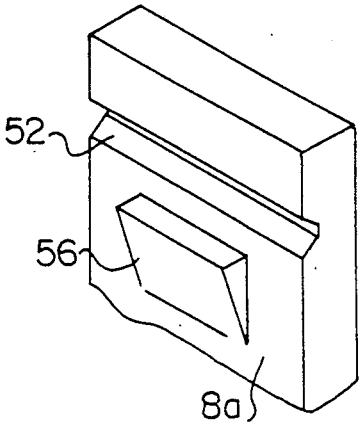

According to the embodiment shown in FIG. 26, a shoulder surface 56 is provided in the rear surface of the free end of the tab 8*a*.

Figure 27:
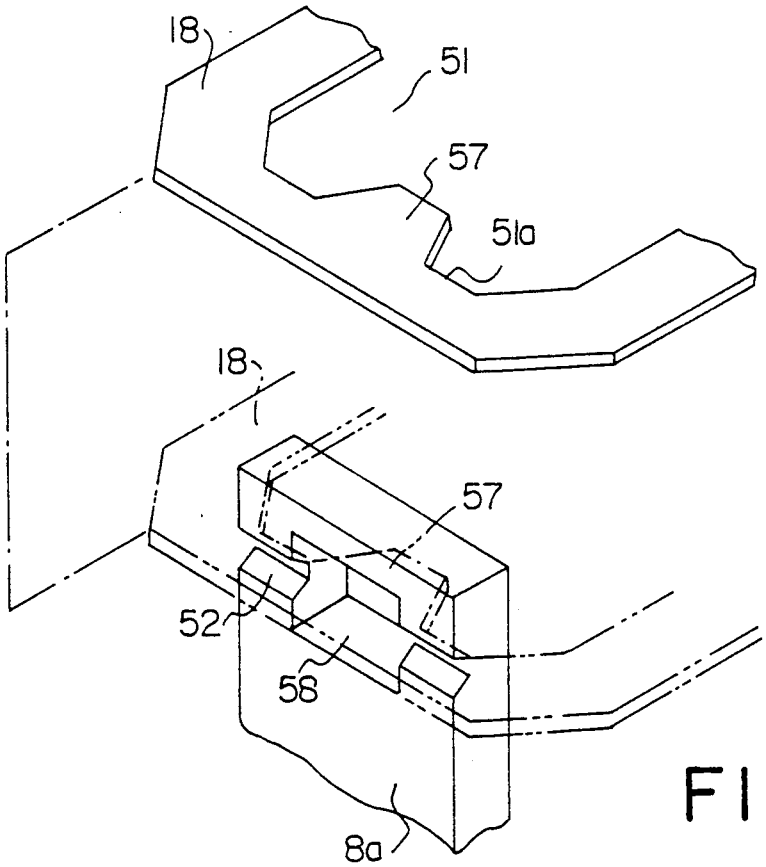
FIG. 27 is a fragmentary, exploded perspective view of yet another embodiment of the base end of the moveable piece and its support structure.

According to the embodiment illustrated in FIG. 27, the lateral plate 51*a* is provided with an inwardly directed projection 57 which can be fitted into a central opening 58 provided in a middle part of the groove 52. Thus, the projection 57 is engaged by the opening 58, and can positively retain the base end of the moveable piece in position.

Figure 28:
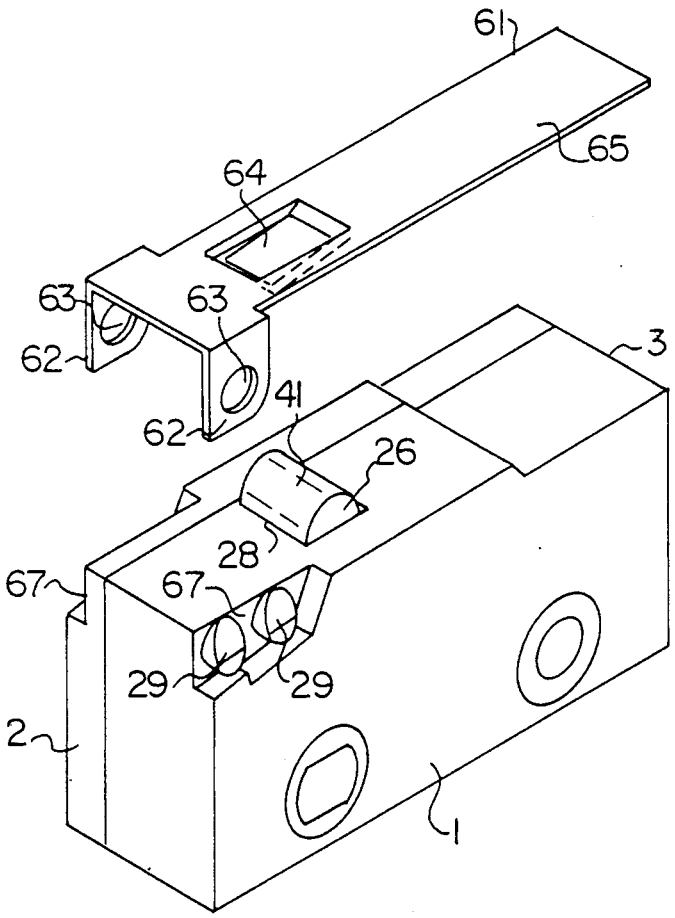
FIG. 28 is an exploded perspective view of the microswitch showing how the lever member or the actuator is pivotally attached thereto.

As best shown in FIG. 28, a depression 67 having a flat bottom surface is provided in each of the corresponding corner portions of the two casing halves, and the bottom surfaces of the depressions 67 are each provided with a pair of pivot pins 29 serving as pivotal support portions one next to the other.

Numeral 61 denotes an actuator which is provided with a pair of pivotal support pieces 62 bent from one end thereof, and these pivotal support pieces 62 are provided with pivotal support openings 63 serving as pivoted portions for mounting the actuator 61 on the casing by fitting these pivotal openings 63 onto the pivot pins 29.

The actuator 61 is further provided, adjacent to the pivotal support pieces 62, with pressure application part 64 which is stamp formed so as to project downwardly for pressing the button portion 41 of the push-button 26, and a working end 65 which is intended to cooperate with conveyed articles is provided on the side of the actuator 61 opposite to the pivotal support pieces 62.

Figure 29:
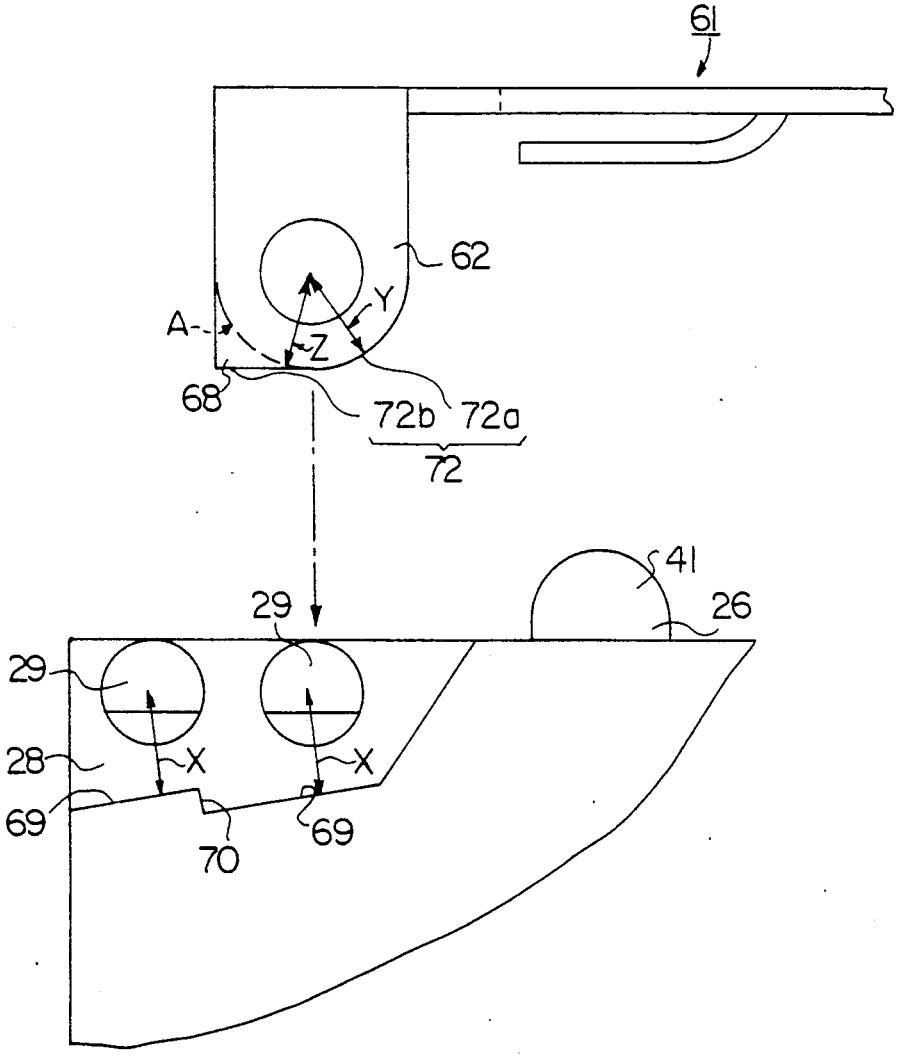
FIG. 29 is an enlarged side view showing the relationship between the base end of the lever member and the pivot support portion of the casing.

The above described structure is similar to that of a conventional actuator mounted type microswitch, and the unique feature of the present invention are described in the following with reference to FIG. 29.

The edge 72 of each of the pivotal support pieces 62 of the actuator 61 defining a rotary outer peripheral surface is provided with a rounded shape at its first corner portion 72*a* but defines a rectangular corner at its second corner portion 72*b*. Further, the part of the second corner portion 72*b* projecting from the rotary peripheral boundary A indicated by the dotted line forms a positioning engagement portion 68 of the actuator 61.

On the other hand, the part of the wall surface rising from the bottom surface of the depression 67 and facing the pivot pins 29 of the casing so as to oppose the lower edge 72 of each of the pivotal support pieces 62 is formed by a pair of sloping surfaces 69 which present a same distance and inclination with respect to the corresponding pivot pins 29 and mutually connected by a stepped portion 70.

And, if the distance from the center of each of the pivot pins 29 to the part of the corresponding sloping surface 19 which is closest to the center of the pivot pin 29 is X, the distance from the center of the pivot openings 63 of the actuator to the rounded corner portion 72*a* of the lower edge 72 of the actuator 61 is Y, and the distance from the first corner portion 72*a* to the beginning point of the second corner portion 72*b* connected to the first corner portion is Z, the relationship $Y<X<Z$ holds.

Now the positioning action of the actuator 61 is described in the following with reference to FIGS. 30 and 31.

Figure 30:
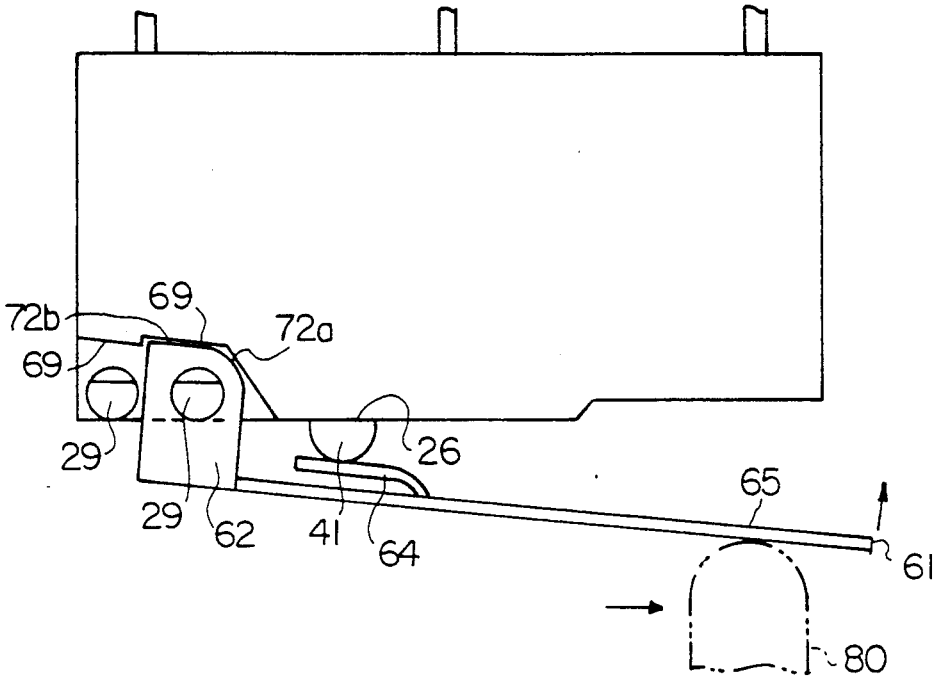
FIGS. 30 and 31 are side views of the microswitch for illustrating its operation.
Figure 31:
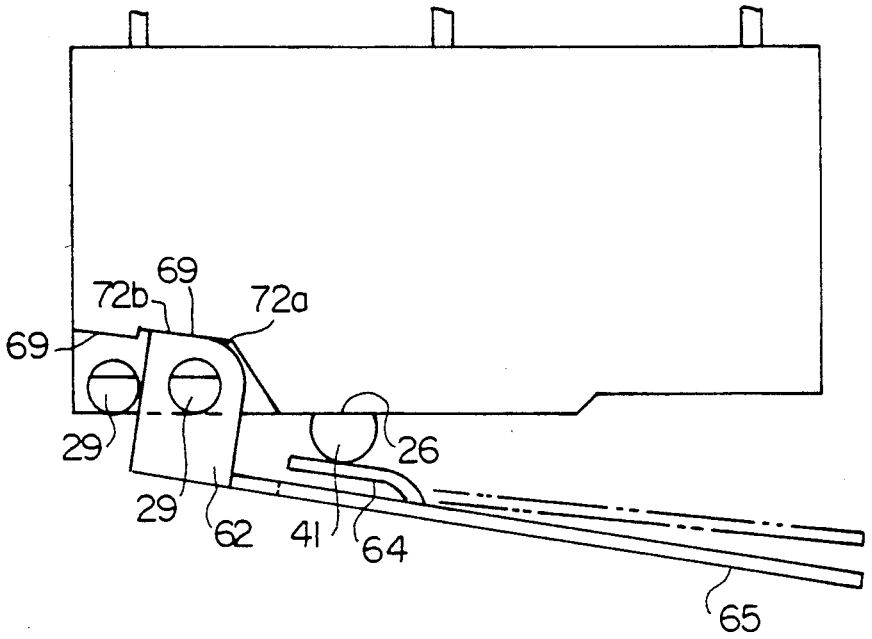

When the microswitch 61 is to be used with its actuator positioned at its lower part, the pressure from a conveyed article 80 applied to the working end 65 of the actuator 61 causes the actuator 61 to be pushed up as shown in FIG. 30, and its pressure application portion 64 presses the button portion 41 of the push-button 26.

When the conveyed article 80 has passed through and the actuator 61 has been brought into a free state, the working end 65 rotates downwardly under its weight, and releases the pressure upon the button portion 41. This rotation is carried out with the first corner portions 72 of the pivotal support pieces 62 without contacting the sloping surfaces 69 owing to the relationship $Y<X$. A further rotation of the actuator 61 causes the second corner portions 72*b* serving as the positioning engagement portions to contact and engage with the sloping surfaces 69 owing to the relationship $X<Z$. Thus, the actuator 61 is positioned at an orientation which aligns with the inclination of the sloping surface 69.

Thus, the uniform positioning of the actuator in its free state is ensured, and the impact to the actuator as a conveyed article collides with the actuator 61 is controlled to a desired magnitude.

In the above described embodiment, the bottom surface of each of the depressions 67 of the casing was provided with a pair of pivot pins 29, and these were provided so as to be selectively used by taking into account the pressure stroke of the actuator 61 that is desired in each particular application.

According to this structure, when the actuator is held in a free state, and it has rotated a certain angle under its own weight, the positioning projection of the actuator engages with the corresponding surface of the casing.

Therefore, according to this embodiment, since the position of the actuator is secured in its free state, by using it in such a positioned state as to cooperate with articles which are to be conveyed, the impacts upon the microswitch can be reduced with the result that there is provided an actuator mounted type microswitch which can be used in a stable fashion irrespective of its orientation.

What we claim is:

1. A microswitch, comprising:

a casing consisting of a base casing half and a cover casing half;

at least a pair of terminal pieces received, at intermediate parts, in slots provided in said base casing half and extending substantially perpendicularly from a surface opposing a corresponding surface of said cover casing half, each of said terminal pieces being provided with a first end extending in a cavity defined in said casing and a second end extending out of said casing;

a contact mechanism accommodated in said cavity and electrically connected to said terminal pieces; and a push-button member elastically supported by spring means and projecting out of said casing for actuating said contact mechanism by movement of said push-button member;

at least one of said terminal pieces being provided with a projection extending from a leading edge of said at least one terminal piece which is adapted to be received in one of said slots, and said slot being provided with a recess for receiving said projection;

wherein said slot comprises an external part adjoining said cover casing half and an internal part, adjoining said recess, said internal part being narrower than said external part, and a projecting length of said projection as measured from said leading edge of said terminal piece is larger than a depth of said internal part measured as a distance between a bottom surface of said internal part and a boundary between said external part and said internal part.

2. A microswitch according to claim 1, wherein said internal part and said external part are both defined by mutually parallel side walls of said slot, and said two parts are separated by stepped shoulder surfaces.

3. A microswitch according to claim 1, wherein said external part is defined by a pair of converging wall surfaces of said slot, and said internal part is defined by a pair mutually parallel side wall surfaces of said slot, said two parts being separated from each other by continuous transition of said converging wall surfaces to said parallel wall surfaces of said slot.

4. A microswitch according to claim 1, wherein said slot is provided with a groove extending in a direction in which said at least one of said terminal pieces is received in said one of said slots and substantially the entire depth of said slot.

5. A microswitch according to claim 4, wherein said cover casing half is provided with a pair of side walls which extend along external side surfaces of said base casing half in parallel with said slot, and another groove extending in parallel with said groove is defined between one of said side walls of said cover casing half and a corresponding one of said external side surfaces of said base casing half.

6. A microswitch according to claim 1, wherein said first end of said terminal piece is supported by two points of said base casing half, one of said support points being located in a relatively less flexible part of said base casing half and being a readily deformable projection.

7. A microswitch according to claim 6, wherein said deformable projection is provided with grooves on either side thereof.

8. A microswitch according to claim 6, wherein said projection is provided with a tapered free end.

9. A microswitch according to claim 7, wherein said projection is provided with a tapered free end.

10. A microswitch according to claim 1, wherein said first end carries a contact point and is provided with a lateral projection adjacent to said contact point.

* * * * *